US007681424B2

(12) United States Patent
Antonucci

(10) Patent No.: US 7,681,424 B2
(45) Date of Patent: Mar. 23, 2010

(54) SWING HANDLE LATCH

(75) Inventor: Jeffrey L. Antonucci, West Chester, PA (US)

(73) Assignee: Southco, Inc., Concordville, PA (US)

( * ) Notice: Subject to any disclaimer, the term of this patent is extended or adjusted under 35 U.S.C. 154(b) by 172 days.

(21) Appl. No.: 11/735,323

(22) Filed: Apr. 13, 2007

(65) Prior Publication Data

US 2007/0240463 A1 Oct. 18, 2007

Related U.S. Application Data

(60) Provisional application No. 60/792,572, filed on Apr. 16, 2006.

(51) Int. Cl.
*E05B 47/06* (2006.01)

(52) U.S. Cl. ..... 70/208; 70/210; 70/278.7; 70/279.1; 70/283; 292/207; 292/336.3; 292/DIG. 31

(58) Field of Classification Search ..... 70/278.7, 70/279.1, 283, 208, 210, 277, 278.3, 283.1; 292/336.3, 359, 207, 210, DIG. 31
See application file for complete search history.

(56) References Cited

U.S. PATENT DOCUMENTS 1,833,572 A * 11/1931 Hardesty ..... 70/262
3,016,968 A * 1/1962 Roberts, Jr. et al. ..... 180/89.1
3,504,511 A * 4/1970 Allen ..... 70/241
3,751,088 A * 8/1973 Schlage ..... 292/201
4,268,076 A * 5/1981 Itoi ..... 292/216
5,010,751 A * 4/1991 Schwartz et al. ..... 70/276
5,058,258 A * 10/1991 Harvey ..... 29/401.1
D344,881 S 3/1994 Sauerland
5,487,289 A * 1/1996 Otto et al. ..... 70/279.1
D384,874 S 10/1997 Hoffmann
5,722,269 A 3/1998 Simon et al.
5,873,274 A 2/1999 Sauerland
5,893,282 A 4/1999 Runge et al.
6,182,483 B1 2/2001 von Kathen et al.
6,363,761 B1 4/2002 Sauerland (Continued)

OTHER PUBLICATIONS

Dirak, www.dirak.com, Dirak Intelligent Products, Wireless Swinghandle w/Reader (1page), HID 485 Swinghandle W/Reader (1 page), and HID Direct Swinghandle W/Reader, Sep. 2004, Germany.

(Continued)

*Primary Examiner*—Lloyd A Gall
(74) *Attorney, Agent, or Firm*—Paul & Paul

(57) ABSTRACT

A latch has a pawl, a handle connected to the pawl, a manual lock for preventing movement of the handle between a closed position and an open position, an electrical lock for preventing movement of the handle between the closed position and the open position, and a shuttle connected to both the manual lock and the electrical lock. The shuttle is moveable between an engaged position in which the handle is prevented from moving from the closed position to the open position and a disengaged position in which the handle is permitted to move from the closed position to the open position. Upon deenergization of the electrical lock, the shuttle remains in the engaged position if the shuttle was in the engaged position prior to deenergization and the shuttle remains in the unengaged position if the shuttle were in the unengaged position prior to deenergization.

7 Claims, 20 Drawing Sheets

U.S. PATENT DOCUMENTS

| | | | | |
|---|---|---|---|---|
| 6,490,896 | B2 * | 12/2002 | Segawa | 70/208 |
| 6,794,572 | B1 * | 9/2004 | Chiang | 174/50 |
| 7,040,125 | B2 | 5/2006 | Ciezki | |
| 7,089,770 | B2 | 8/2006 | Ramsauer et al. | |
| 2006/0032418 | A1 * | 2/2006 | Smith | 109/59 R |
| 2006/0248931 | A1 * | 11/2006 | Boulard et al. | 70/208 |
| 2007/0209413 | A1 * | 9/2007 | Dobbs | 70/279.1 |
| 2008/0105012 | A1 * | 5/2008 | Poppell | 70/279.1 |

OTHER PUBLICATIONS www.emka-electronic, Stand-alone System—Locking System Unit, 2 pages, Jul. 2007, Germany.

Kemper, Kevin; "APC Invention Disclosure Record"; Sep. 8, 2005; 11 pages.

* cited by examiner

Latch in typical installation
Door Closed

Latch in typical installation
Door Open 15°

SWING HANDLE LATCH

CROSS REFERENCE TO RELATED APPLICATIONS

This application claims priority to U.S. Provisional Application No. 60/792,572, filed on Apr. 16, 2006.

BACKGROUND OF THE INVENTION

1. Field of Invention

The present invention relates to the field of latches.

2. Brief Description of the Related Art

Latches can be used to secure doors, panels or other members. It is desired that the latch be securely locked when the latch is not in use and therefore prevent unauthorized use by one who does not have a key or tool to unlock the latch. Once unlocked the latch can be opened and then closed.

Although many latches are known in the prior art, none are seen to teach or suggest the unique features of the present invention or to achieve the advantages of the present invention.

SUMMARY OF THE INVENTION

The present invention is directed to a latch for securing two members together. The latch can be attached to one of the members such as a panel. The latch can be unlocked electrically without the manual assistance of a user and optionally the latch can be electrically unlocked remotely.

The present invention includes a housing, a latch pawl for engaging a surface such as a keeper on the second member, and a handle for moving the latch pawl between the latched position and the unlatched position. The latch pawl engages a surface of the second member such that the first member is fastened to the second member. A handle means such as a handle is connected to the pawl for moving the pawl between a closed or latched position in which the pawl engages the second member and an open or unlatched position in which the pawl does not engage the second member when the handle is in the closed position.

A manual locking means is provided for preventing movement of the handle between a locked position in which the handle is prevented from moving from the closed position to the open position and an unlocked position in which movement of the handle from the closed position to the open position is permitted. The manual locking means is moveable between the locked position and the unlocked position by manual operation of the manual locking means.

An electrically actuated locking means is provided for preventing movement of the handle or handle means between a locked position in which the handle means is prevented from moving from the closed position to the open position and an unlocked position in which movement of the handle means from the closed position to the open position is permitted. The electrically actuated locking means is moveable between the locked position and the unlocked position by electrical actuation of said electrically actuated locking means.

A shuttle means or shuttle is connected to both the manual locking means and the electrically actuated locking means for moving between an engaged position in which the shuttle prevents movement of the handle from the closed position to the open position and an unengaged position in which movement of the handle from the closed position to the open position is permitted. The shuttle is moveable between the engaged and disengaged position in two ways. The shuttle is moveable between the engaged and disengaged position by movement of the manual locking means between the locked position in which the shuttle is in the engaged position and the unlocked position in which the shuttle is in the unengaged position. The shuttle is also moveable between the engaged and disengaged position by movement of the electrically actuated locking means between the locked position in which the shuttle is in the engaged position and the unlocked position in which the shuttle is in the unengaged position The electrically actuated locking means is bistable which means that upon deenergization of the electrically actuated locking means the shuttle remains in the engaged position if the shuttle is in the engaged position prior to deenergization. The shuttle also remains in the unengaged position if the shuttle is in the unengaged position prior to deenergization.

BRIEF DESCRIPTION OF THE DRAWINGS

The present invention will be now described with reference to the accompanying drawings in which.

DETAILED DESCRIPTION OF THE INVENTION

Figure 11:
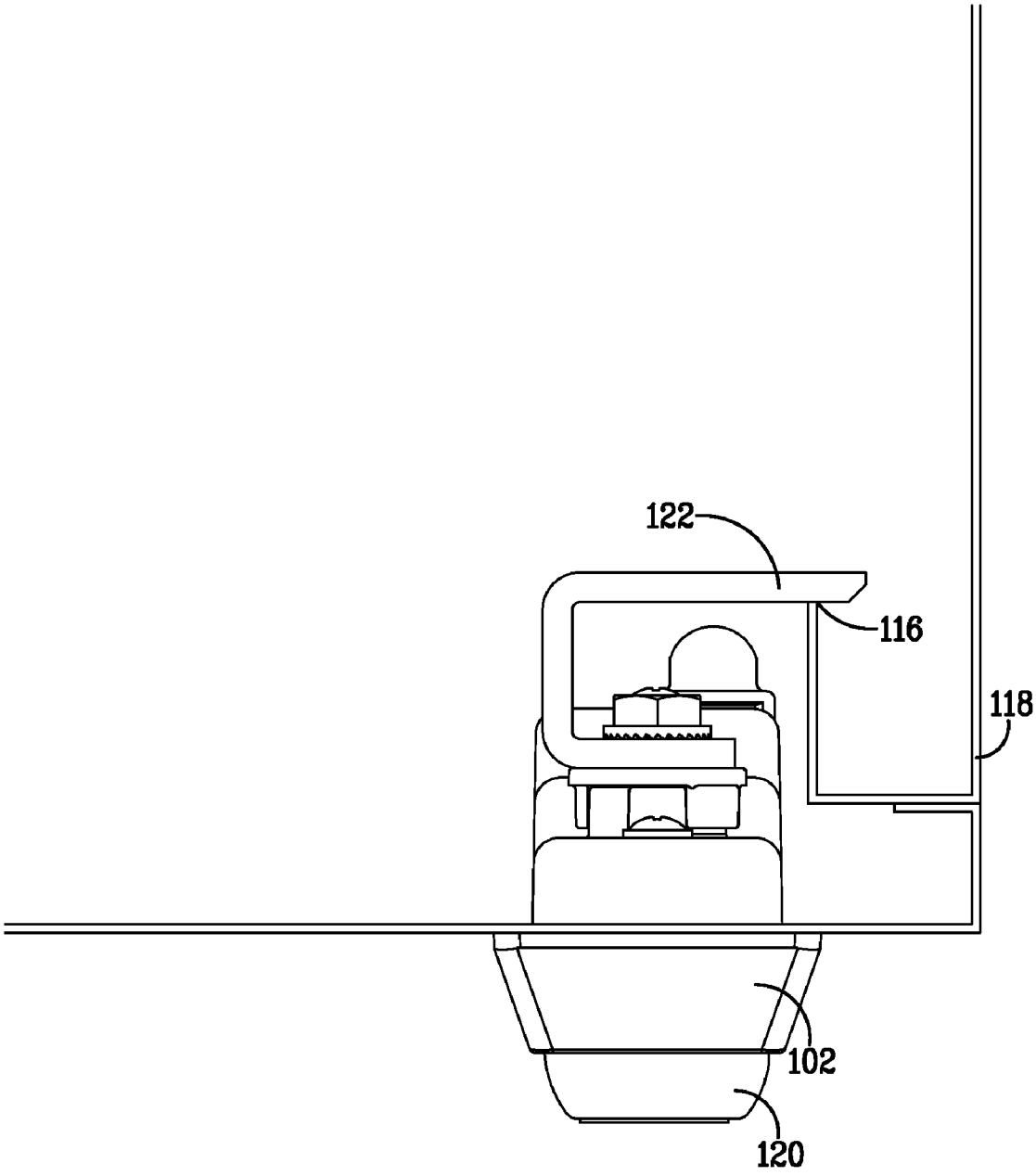
FIG. 11 is a front view of the latch of the present invention in the closed position in a panel member having a pawl securing a second member in the latched position.
Figure 12:
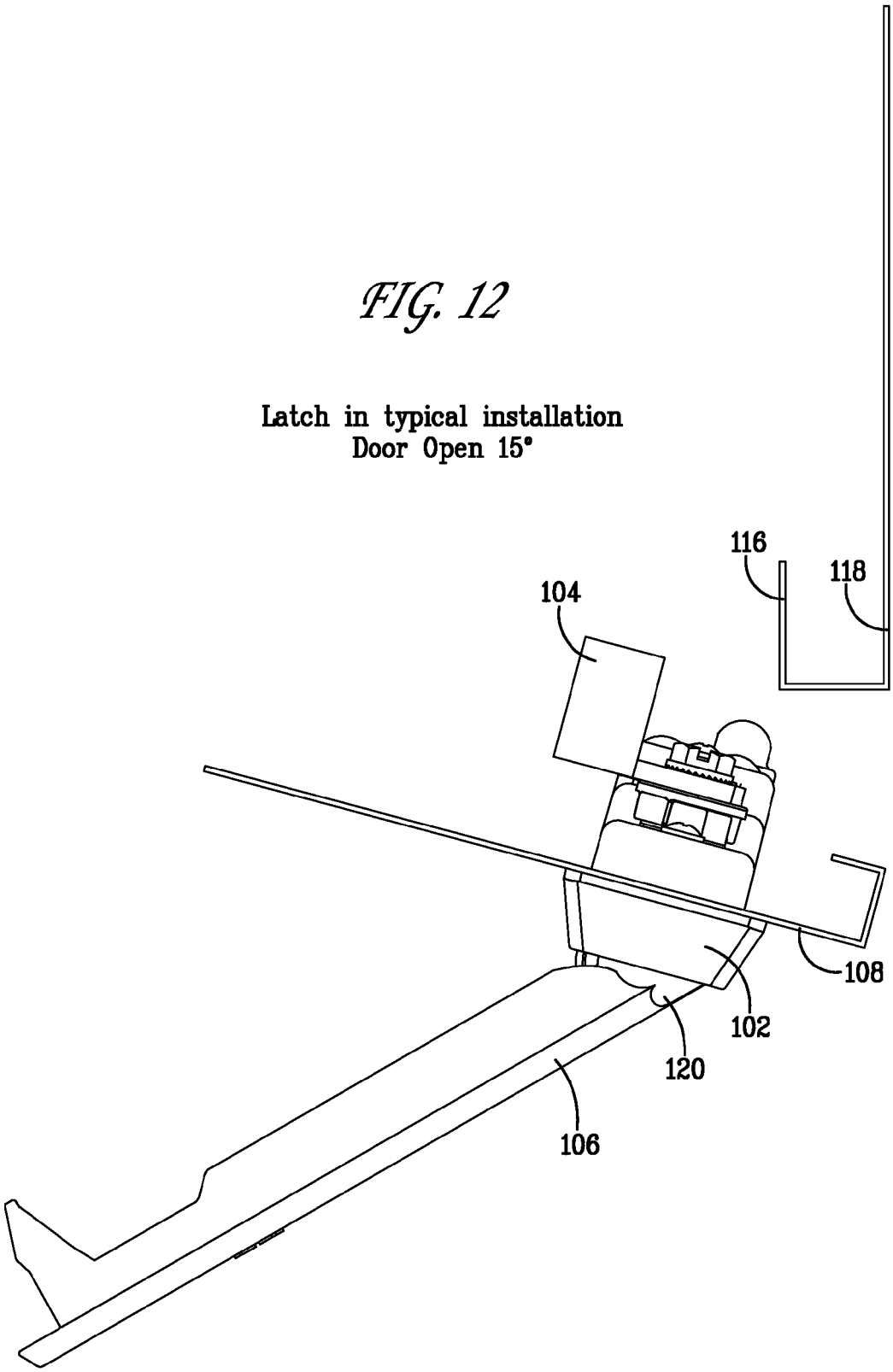
FIG. 12 is a front view of the latch of the present invention in the open or unlatched position in a panel member having a pawl which is not engaging a second panel member.

Referring to FIGS. 1-4, a latch 100 in accordance with a first embodiment of the present invention can be seen. The latch 100 includes a housing 102, a latch pawl 104, a handle means such as handle 106 for selectively moving the latch pawl 104 in and out of engagement with a surface 116 on second member 118 as seen in FIG. 11. Handle 106 has handle swivel end 120. Latch pawl engaging portion 122 engages engaging surface 116 on second member 118 when latch 100 is in the latched or closed position and handle 106 is in the closed position. Handle 106 has handle prong 114 which extends between handle prong supports 124 which in turn extend from lever 106. When the handle 106 is in the closed position and the shuttle 126 is in the engaged position, shuttle catch 112 seen in FIG. 3 engages handle prong 114. To unlatch latch 100, handle 106 from the open or up position is rotated such that latch pawl 104 no longer engages engaging surface 116 of second panel 118 such that first panel 108 can be unfastened from second panel 118 as seen in FIG. 12.

Figure 1:
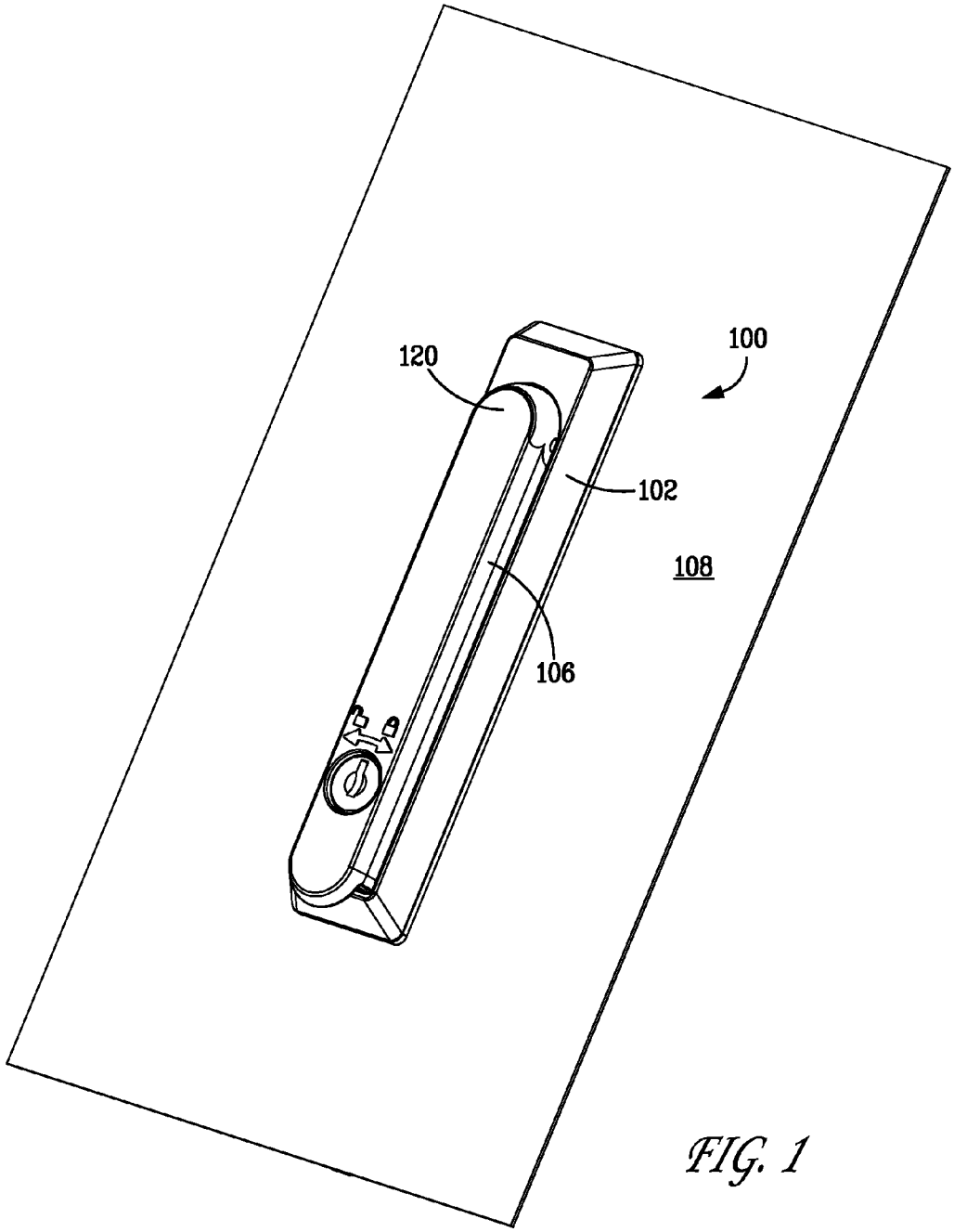
FIG. 1 shows a perspective view of an embodiment of a latch according to the present invention installed in a panel and in the closed position.
Figure 2:
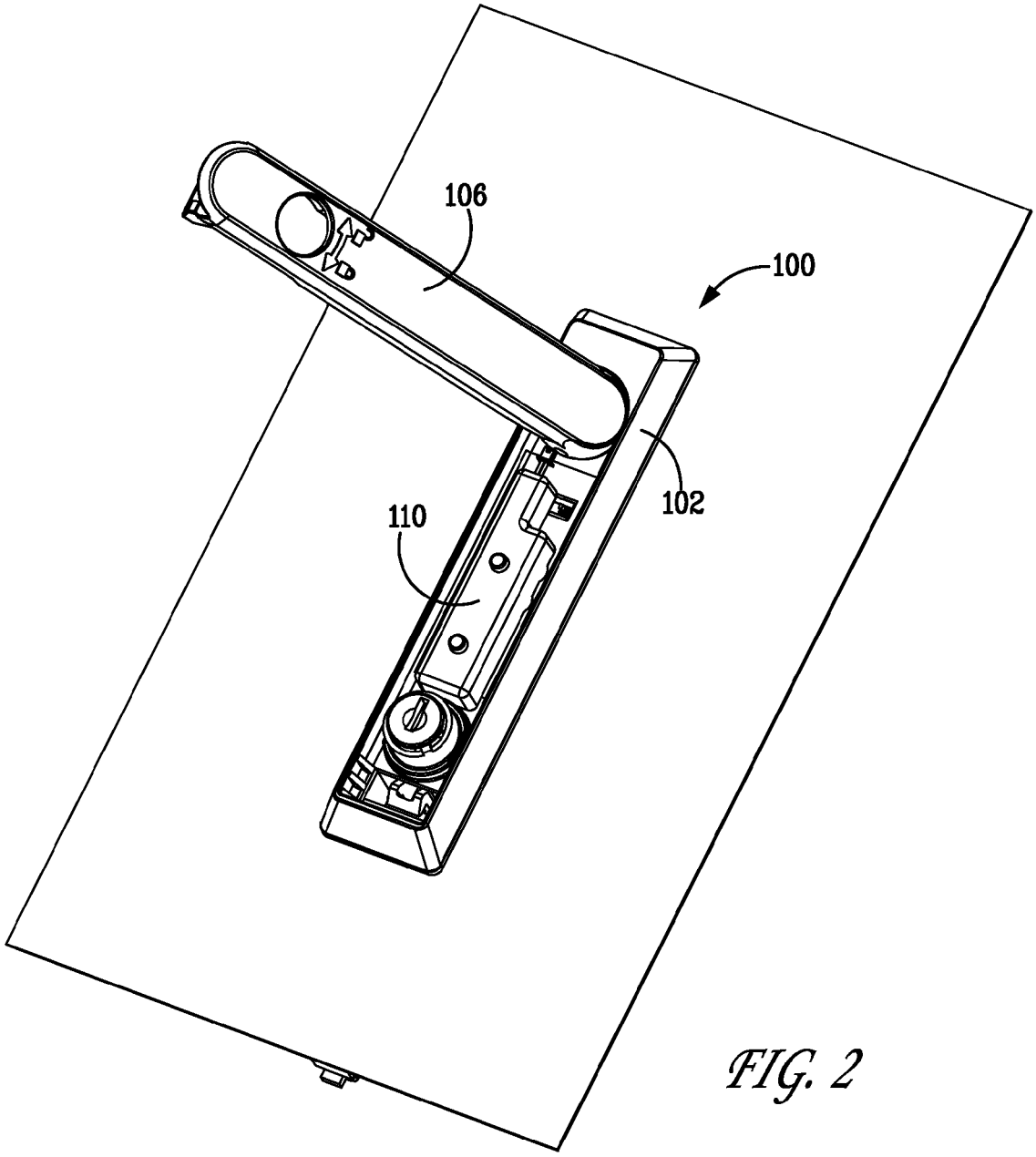
FIG. 2 shows a perspective view of the latch of FIG. 1 in the open position with the handle being rotated about 90 degrees.
Figure 3:
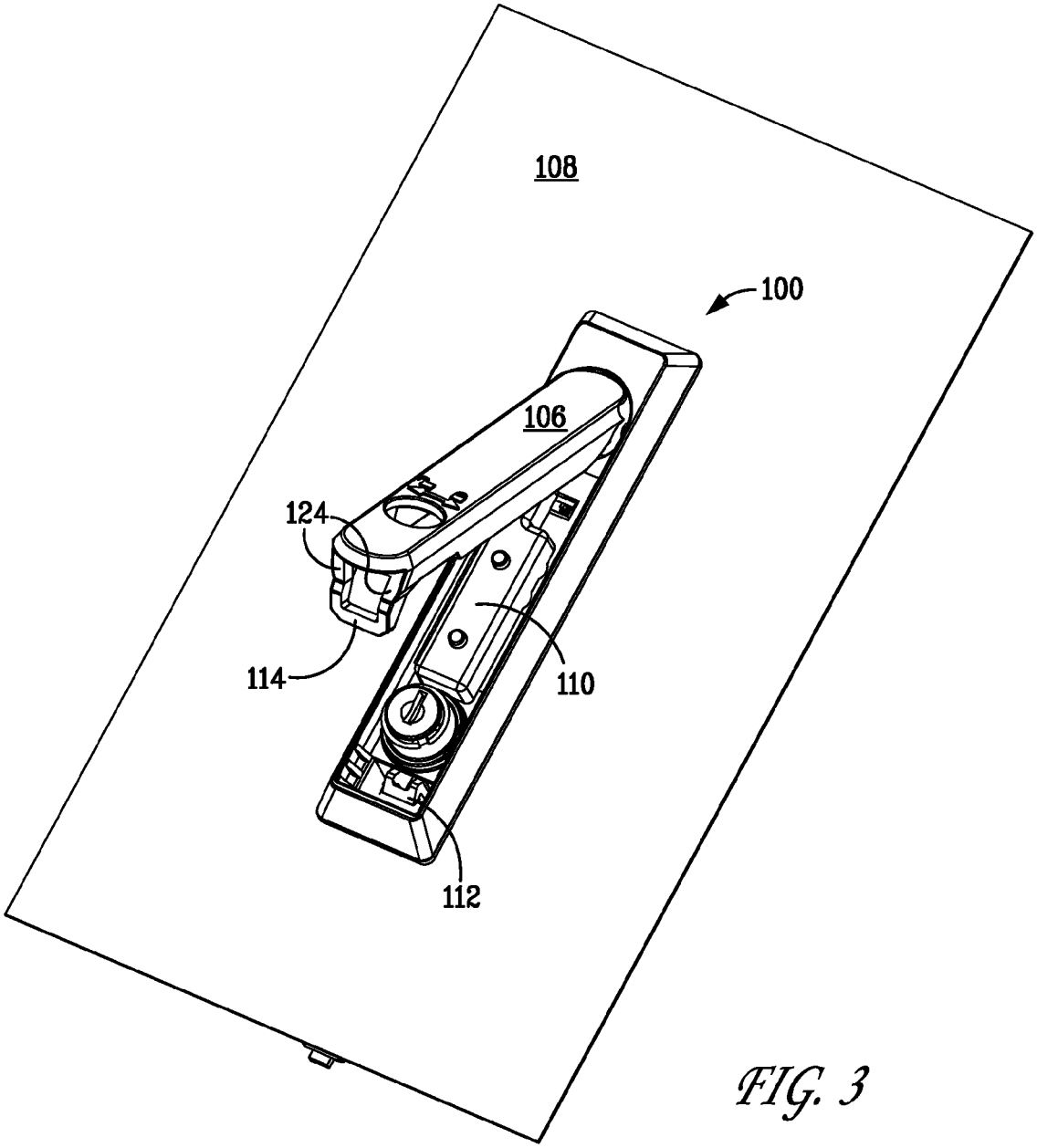
FIG. 3 shows a perspective view of the latch of FIG. 1 prior to the handle being placed in the closed position.
Figures 4, 5, 6, 7, 8, 9, 10:
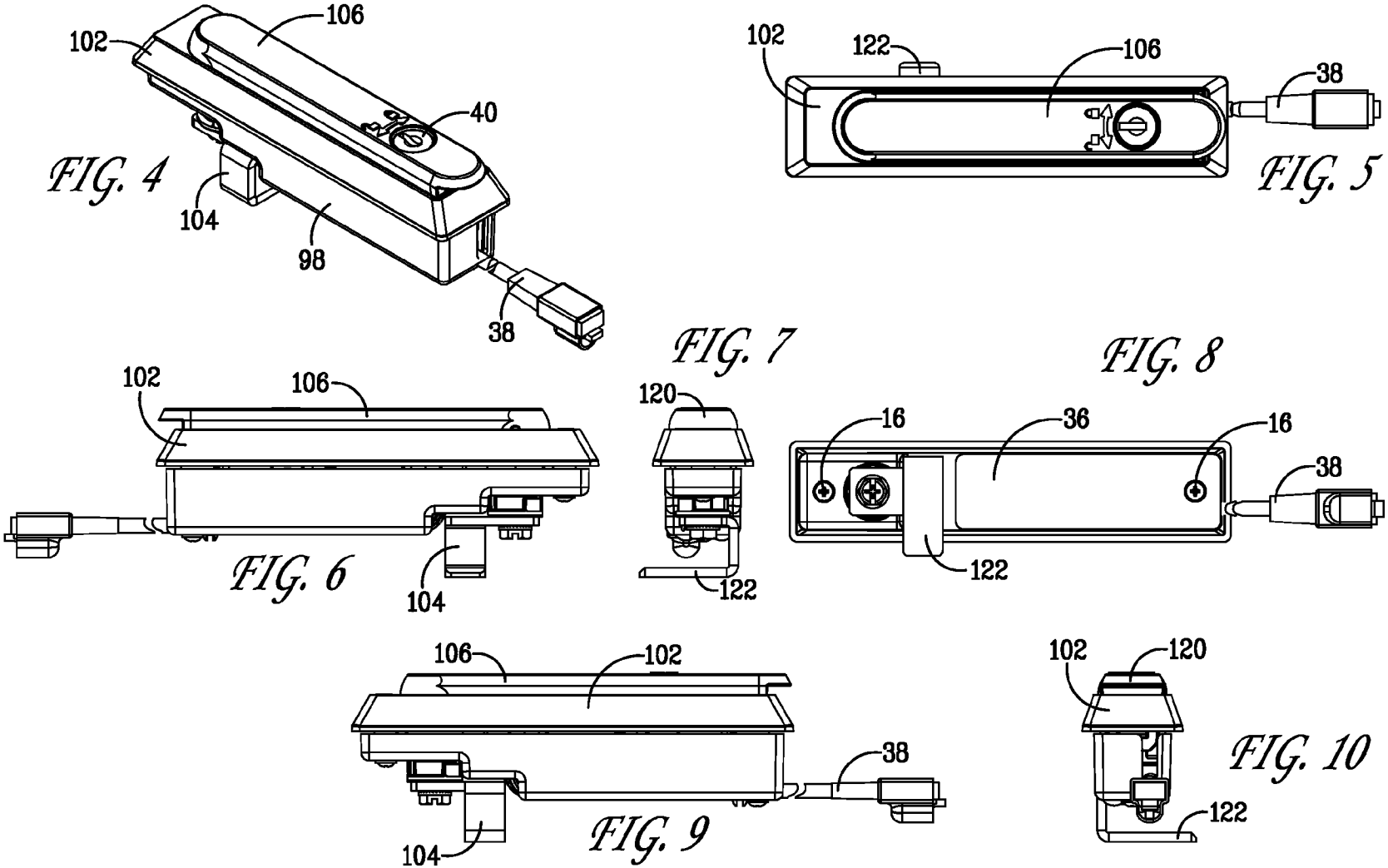
FIG. 4 is a perspective view of the latch of FIG. 1 having a pawl in the closed position.
FIG. 5 is a top view of the latch of FIG. 1 in the closed position.
FIG. 6 is a right side elevational view of the latch of FIG. 1 in the closed position.
FIG. 7 is a front side elevational view of the latch of FIG. 1 in the closed position.
FIG. 8 is a bottom view of the latch of FIG. 1 in the closed position.
FIG. 9 is a left side elevational view of the latch of FIG. 1 in the closed position.
FIG. 10 is a rear side elevational view of the latch of FIG. 1 in the closed position.
Figure 15:
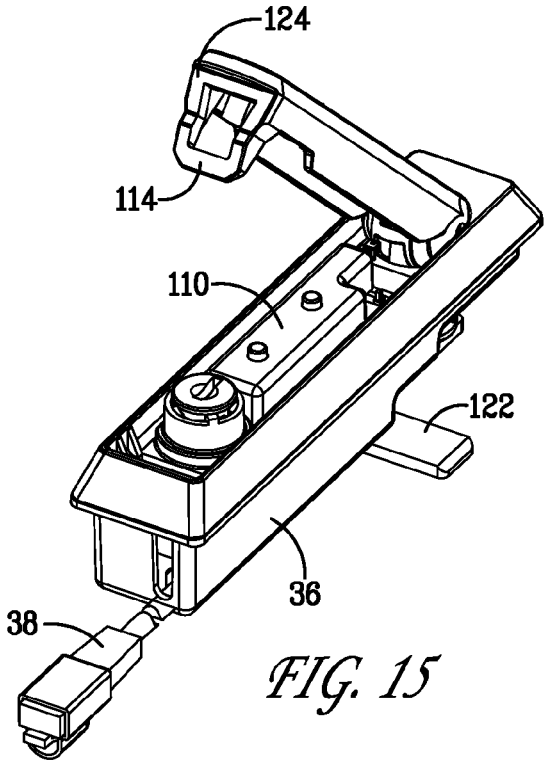
FIG. 15 is a perspective view of the latch of FIG. 1 showing the handle in the open position and the latch in the locked or unlocked position.
Figure 16:
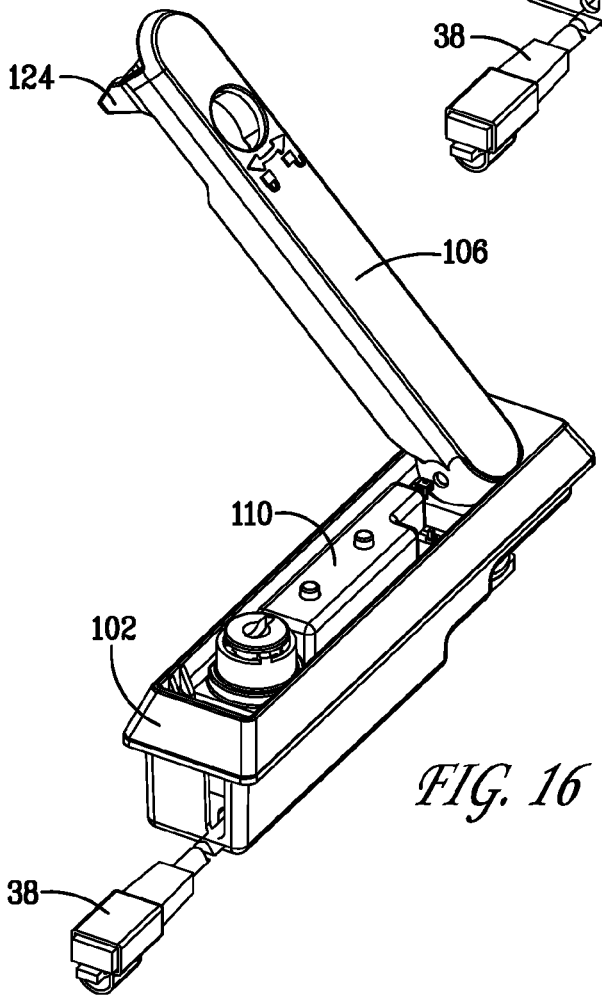
FIG. 16 is a perspective view of the latch of FIG. 1 showing the handle in the open and rotated position and the latch in the locked or unlocked position.
Figure 17:
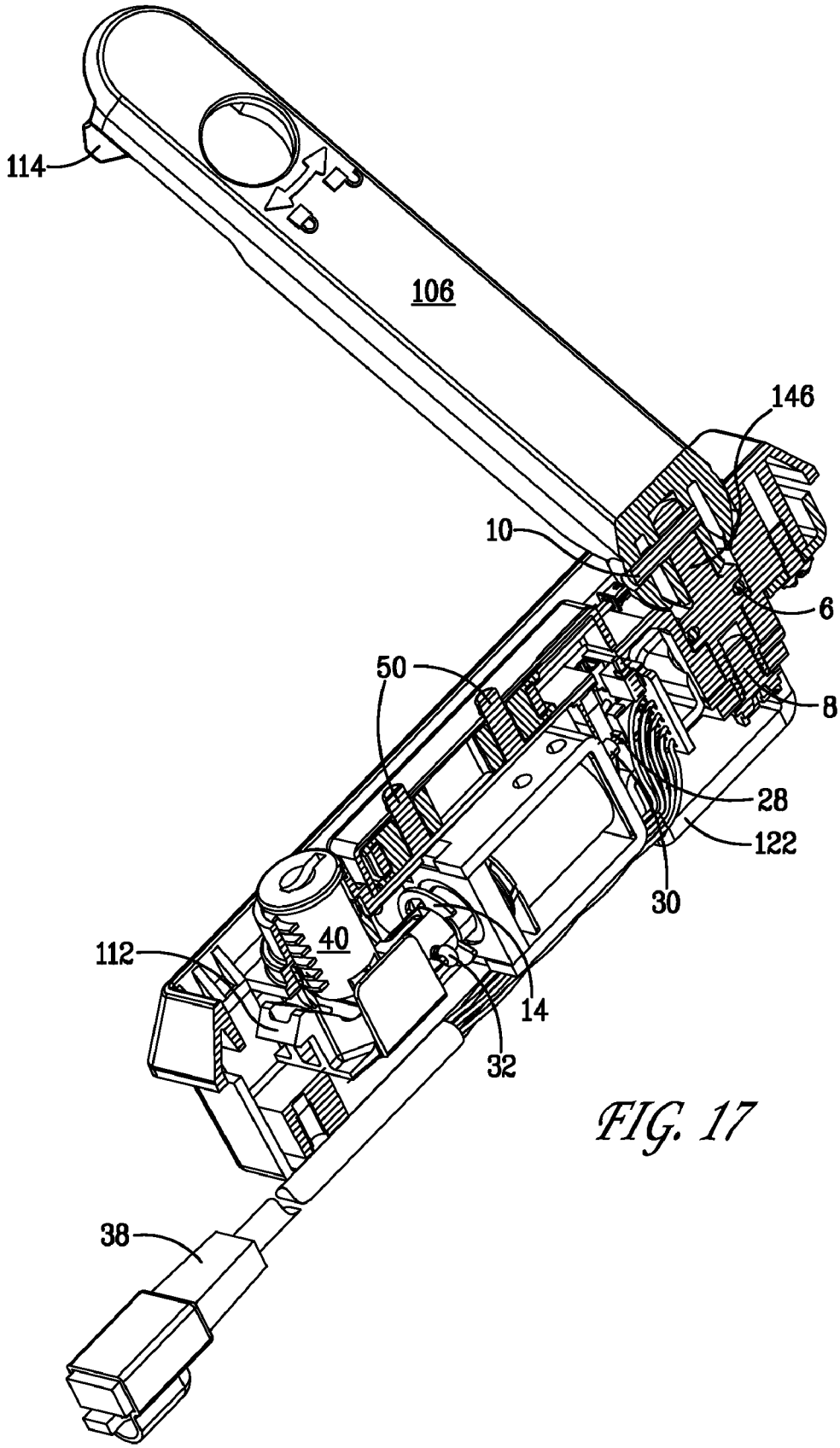
FIG. 17 is a perspective view of the latch of FIG. 1 shown partially in section and the latch in the unlocked position and the handle in the open and rotated position.
Figure 18:
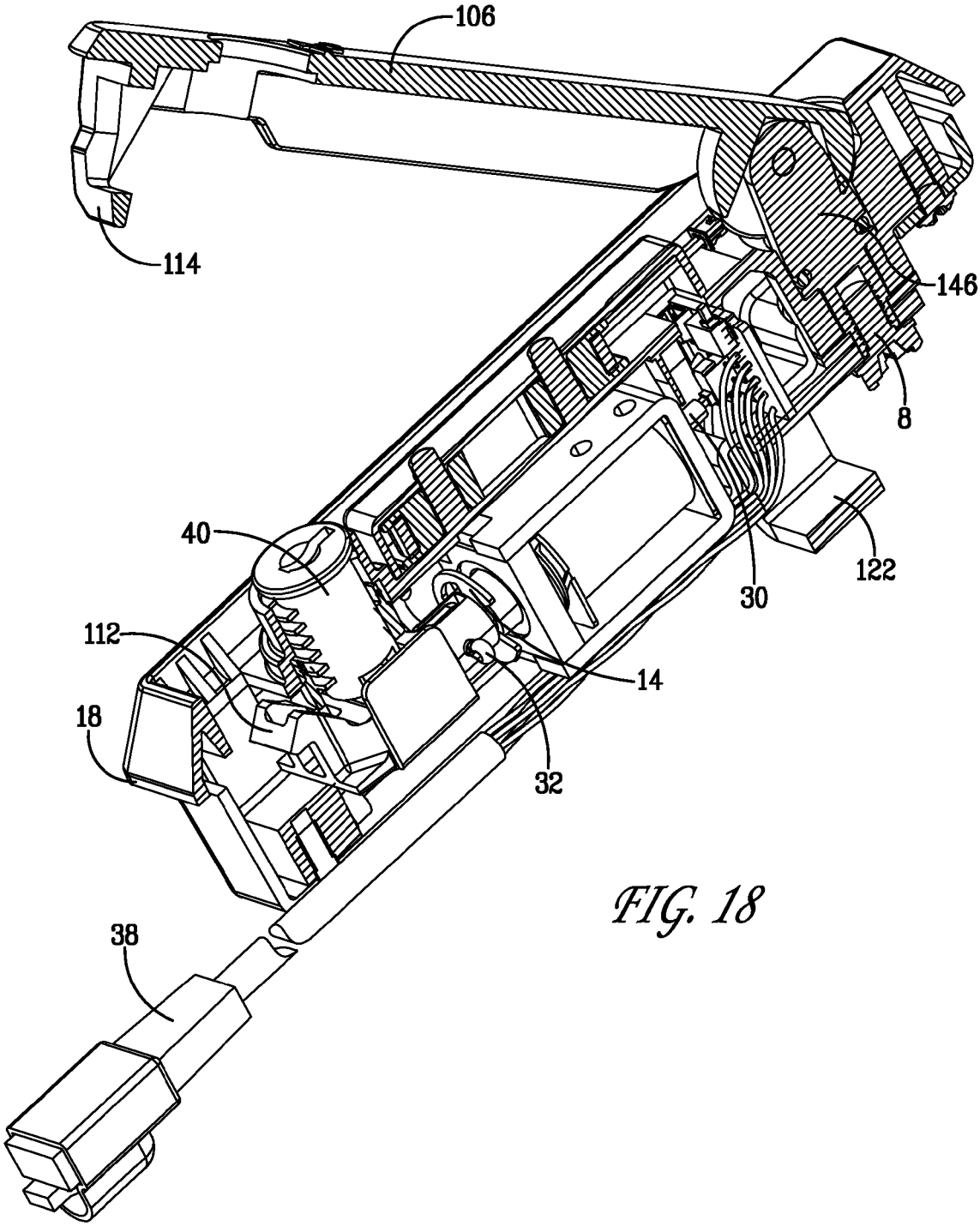
FIG. 18 is a perspective view of the latch of FIG. 1 shown partially in section and the latch in the unlocked position and the handle in the open position.

The latch 100 is generally applicable wherever one or more closure members need to be secured in a certain position such as for a panel door in a frame of cabinet enclosure. In addition, the latch 100 may be mounted in any orientation depending upon the particular application. In one application as seen in FIGS. 11 and 12 latch 100 can be mounted near an edge in panel 108 which can be a sheet metal panel such that latch pawl engaging portion 122 engages engaging surface 116 so as to fasten first panel 108 to second panel or member 118 when the latch is in the latched position. When the latch 100 is in the latched position, handle 106 is in the closed position. To unlatch panel 108 from second panel 118, the latch 100 must first be unlocked by either manual locking means 40 or electrically actuated locking means 4. Then, handle 106 can be moved to the open position as seen in FIGS. 3 and 15. Finally, handle 106 can be swiveled as seen in FIGS. 2 and 16 to rotate latch pawl 104 such that latch pawl 104 no longer engages second member surface 116 of FIG. 11.

Figure 21:
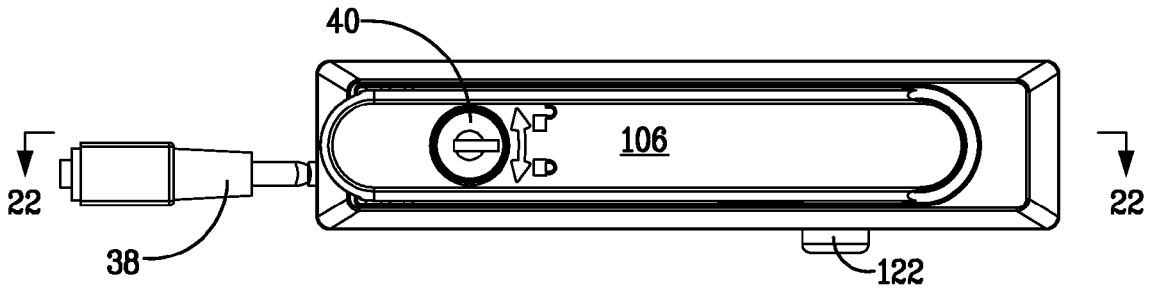
FIG. 21 is a top view of the latch of FIG. 1 in the locked position and the handle closed.
Figure 22:
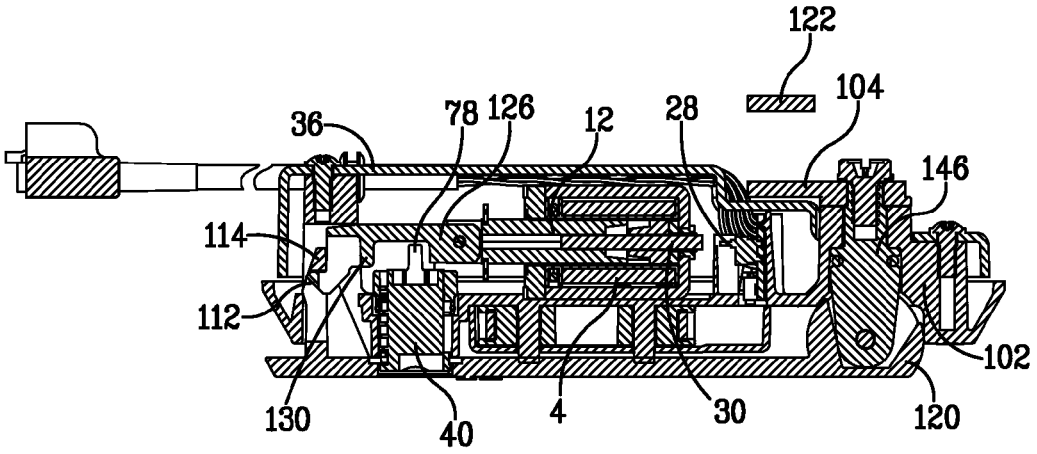
FIG. 22 is a sectional view taken along line 22-22 of FIG. 21.

Reference is made to FIGS. 21 and 22 with respect to the state of the latch 100 in the locked position when handle 106 is in the closed position. Lock plug 40 is rotatable with lock pawl 80 which has lock pawl tooth 78. When lock plug 40 is in the neutral position shown in FIGS. 21 and 22, lock pawl tooth 78 does not engage either shuttle stop 34 or shuttle catch 130. If solenoid 4 is energized from an electrical source then solenoid rod 12 moves in the direction of shuttle catch 130 such that a shuttle means, here shuttle 126 moves toward handle prong 114 of handle 106 thereby permitting shuttle hook 112 to engage handle prong 114 as seen in FIG. 22.

Figure 19:
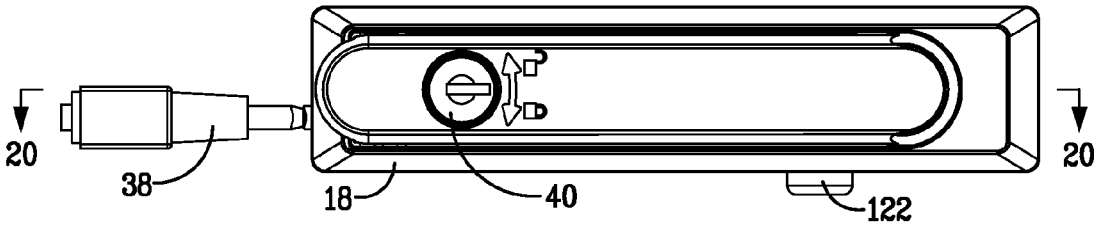
FIG. 19 is a top view of the latch of FIG. 1 in the unlocked position and the handle closed.
Figure 20:
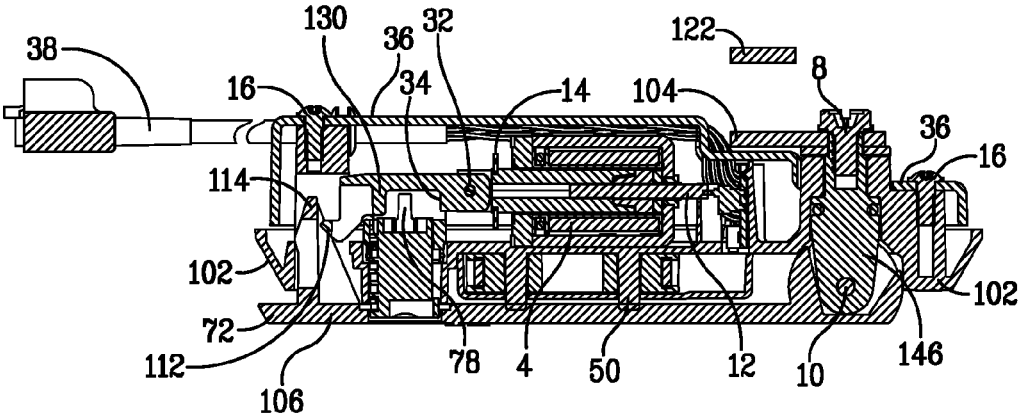
FIG. 20 is a sectional view taken along line 20-20 of FIG. 19.

By reversing the polarity of solenoid 4 which typically is a coil of wire around solenoid pin 30, solenoid rod 12 which is connected by cotter pin 32 to shuttle 126 at shuttle aperture 134 can be moved in the opposite direction as that described above such that shuttle hook 112 no longer engages handle prong 114 as seen in FIGS. 19 and 20. Handle 106 is then permitted to move from the closed position to the open or up position from which the handle 106 can be swiveled so as to rotate latch pawl 104 so that latch pawl 104 disengages second member surface 116.

Figure 25:
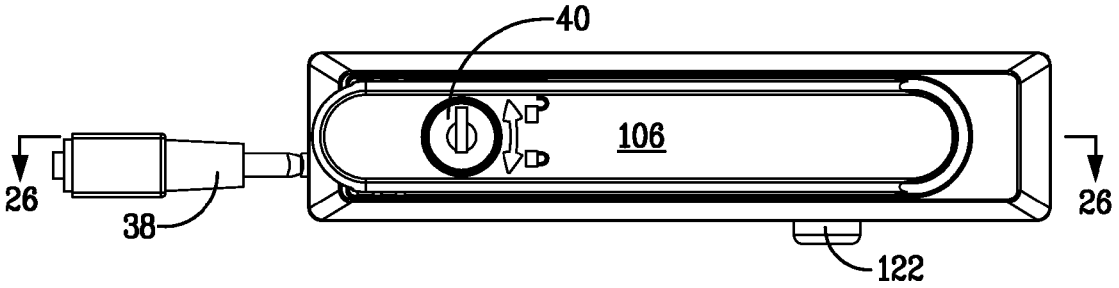
FIG. 25 is a top view of the latch of FIG. 1 in the unlocked position at the moment of actuation of the unlocking of the handle in the closed position.
Figure 26:
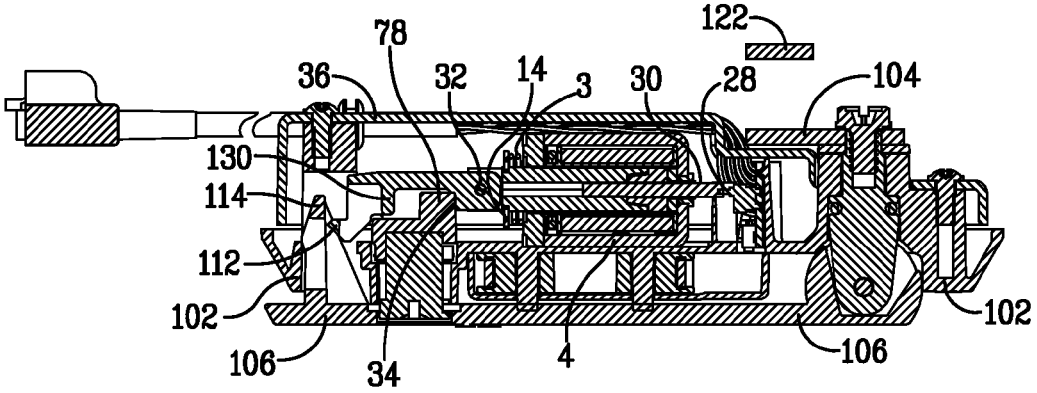
FIG. 26 is a sectional view taken along line 26-26 of FIG. 25.
Figure 32:
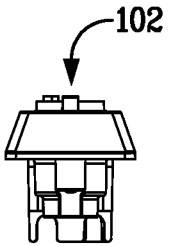
FIG. 32 is a front view of the housing of the latch of FIG. 1.

Alternatively, the latch 100 can be unlocked as seen in FIGS. 25 and 26 by rotating lock plug 40 such that lock pawl tooth 78 engages shuttle stop 34 and moves shuttle 126 and solenoid rod 12 which is connected to shuttle 126 so as to move shuttle hook 112 out of engagement with handle prong 114. The latch 100 is in the unlatched position and handle 106 can be lifted up to the open position, optionally by the use of handle tip 72 such that handle 106 can be rotated so as to disengage latch pawl 104 from second member surface 116 as described above.

Figure 23:
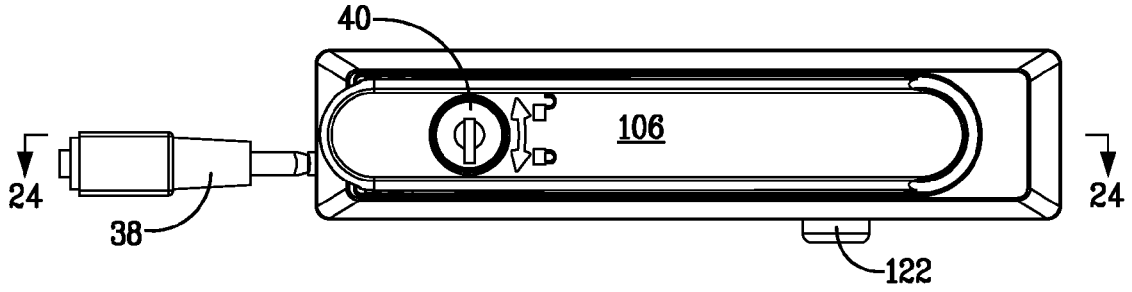
FIG. 23 is a top view of the latch of FIG. 1 in the locked position at the moment of actuation of the locking of the handle in the closed position.
Figure 24:
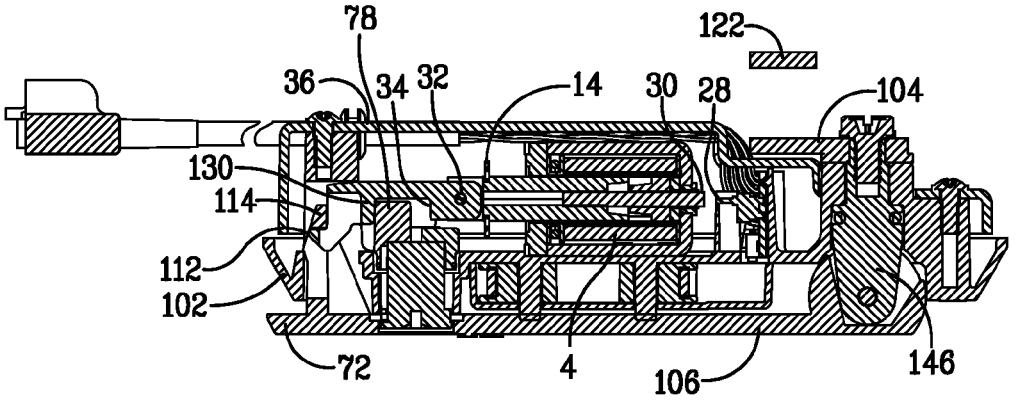
FIG. 24 is a sectional view taken along line 24-24 of FIG. 23.

In addition to being unlockable by solenoid 4, latch 100 can be locked by a manual locking means such as by lock plug 40. As seen in FIGS. 23 and 24, rotation of lock plug 40 moves lock pawl tooth 78 into engagement with shuttle catch 130 such that shuttle 126 together with solenoid rod 12 move shuttle hook 112 into engagement with handle prong 114 thus preventing movement of handle 106 from the locked and closed position.

Figure 13:
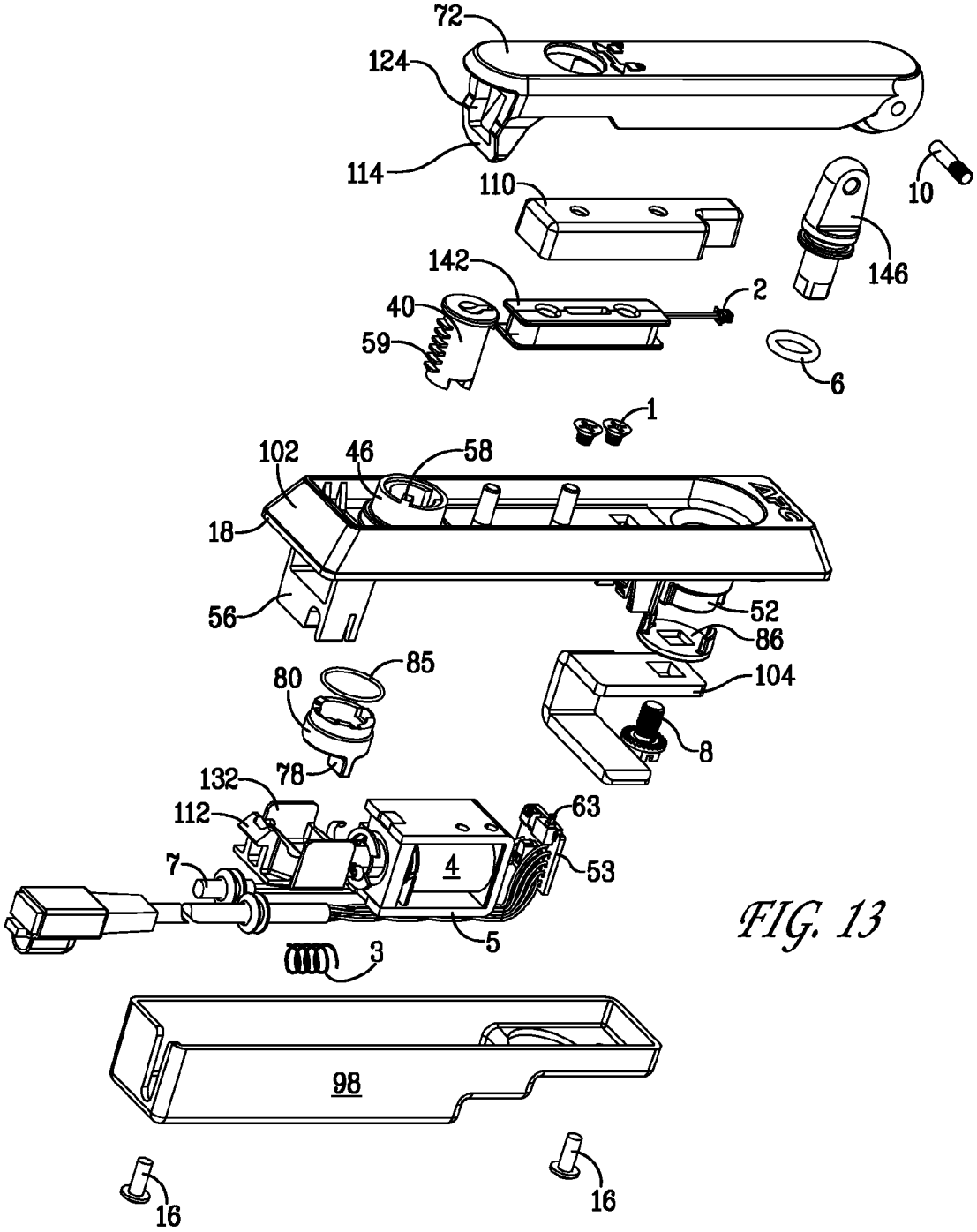
FIG. 13 is an exploded view of the latch of FIG. 1.
Figure 14:
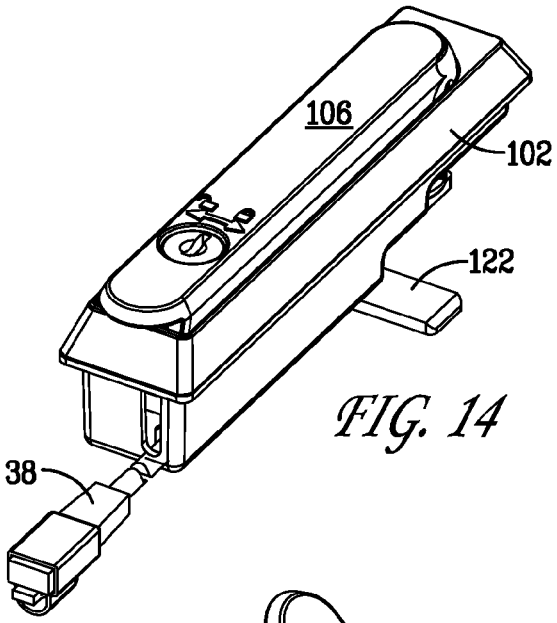
FIG. 14 is a perspective view of the latch of FIG. 1 showing the handle in the closed position and the latch in the locked or unlocked position.
Figure 28:
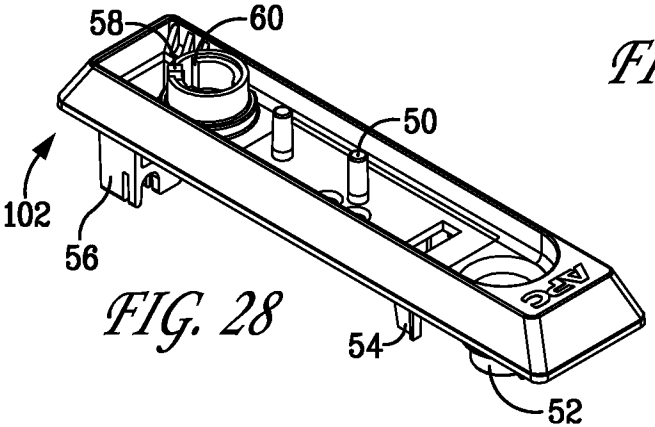
FIG. 28 is a perspective view of the housing of the latch of FIG. 1.
Figure 38:
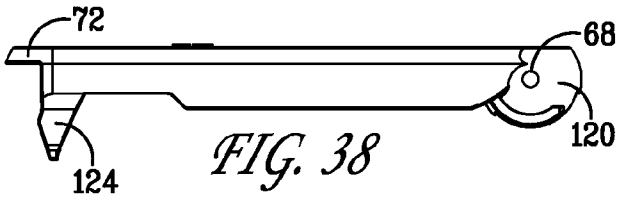
FIG. 38 is a right side elevational view of the handle of the latch of FIG. 1.
Figure 39:
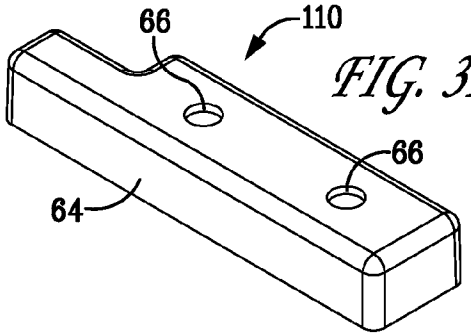
FIG. 39 is a perspective view of the bobbin cover of the latch of FIG. 1.
Figure 40:
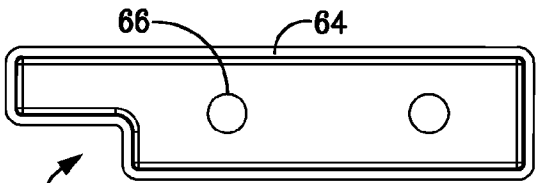
FIG. 40 is a bottom view of the bobbin cover of the latch of FIG. 1.
Figure 34:
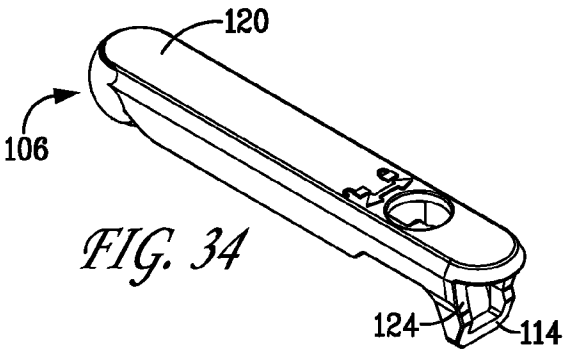
FIG. 34 is a perspective view of the handle of the latch of FIG. 1.
Figure 37:
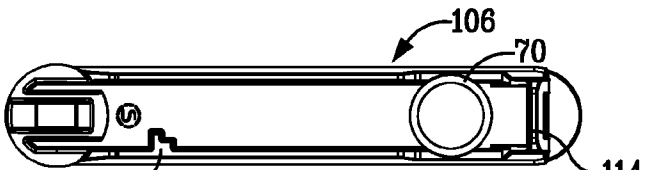
FIG. 37 is a bottom view of the handle of the latch of FIG. 1.
Figure 43:
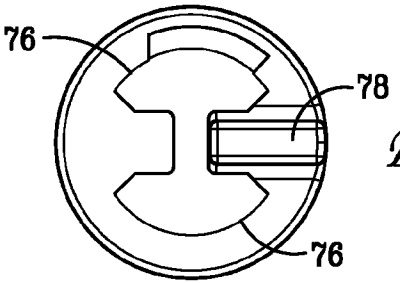
FIG. 43 is a top view of the lock pawl of the latch of FIG. 1.
Figure 42:
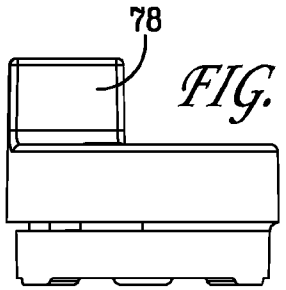
FIG. 42 is a left side elevational view of the lock pawl of the latch of FIG. 1.

Solenoid 4 can be provided with solenoid spring 3 and solenoid stop 14 here a washer so as to bias shuttle 126 and solenoid rod 12 to the locked position as seen in FIG. 26 and 13. After being placed on solenoid rod 12 solenoid stop 14 does not move relative to solenoid rod 12 in normal operation. As seen in FIG. 13, solenoid 4 can be mounted on solenoid mount 5 by solenoid mounting screws 1. Optionally, upon unlocking of the latch 100 by solenoid 4 or by lock plug 40, solenoid pin 30 engages solenoid switch 28 which is connected to circuit board 53 which permits remote monitoring of the status of the solenoid 4. Also latch 100 can be provided with antenna (not shown) connected to antenna switch which can permit opening of the solenoid 4 upon detection of an electromagnetic signal such as the motion of a metallic identification badge. Also the latch can be provided with reed switch 7 which can detect the proximity of a magnet mounted on second member or in close proximity thereto. As seen in FIG. 37, latch handle 106 can have a handle switch actuator 62 which engages handle switch 63 and transmits a signal to circuit board 53. Wires from the circuit board 53 on circuit board support 56 can exit housing wire channel 44 in housing wire support 56 and terminate at cable connector 38 as seen in FIGS. 21, 28 and 30. Solenoid attaching means 48 seen in FIG. 29 in housing 102 provide a means to mount solenoid mount 5.

Figure 29:
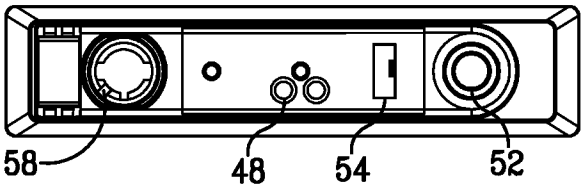
FIG. 29 is a top view of the housing of the latch of FIG. 1.
Figure 31:
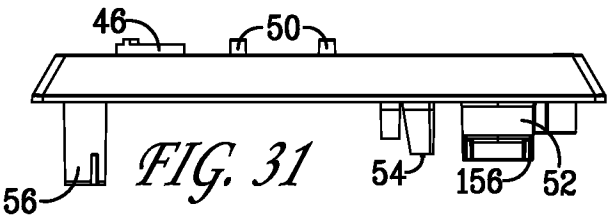
FIG. 31 is a right side elevational view of the housing of the latch of FIG. 1.
Figure 33:
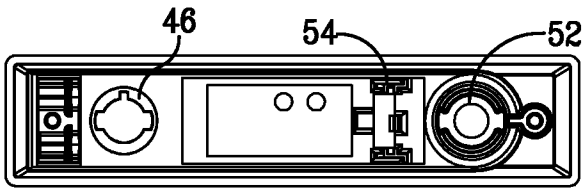
FIG. 33 is a bottom view of the housing of the latch of FIG. 1.
Figure 30:
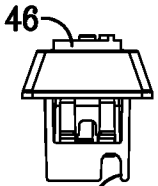
FIG. 30 is a rear view of the housing of the latch of FIG. 1.
Figure 27:
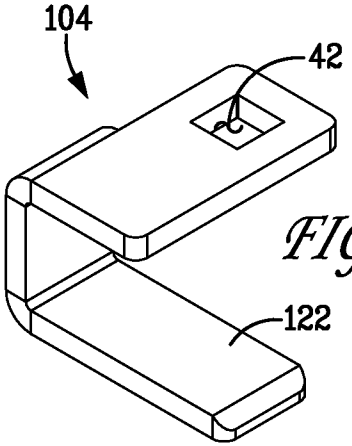
FIG. 27 is a perspective view of the latch pawl of the latch of FIG. 1.
Figure 41:
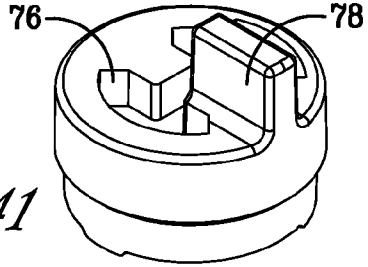
FIG. 41 is a perspective view of the lock pawl of the latch of FIG. 1.
Figure 46:
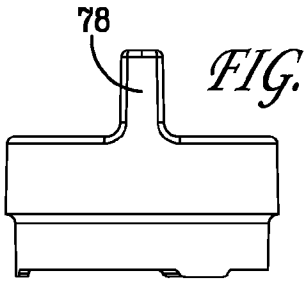
FIG. 46 is a front view of the lock pawl of the latch of FIG. 1.
Figure 45:
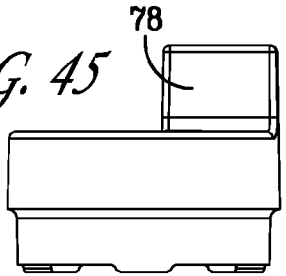
FIG. 45 is a right side elevational view of the lock pawl of the latch of FIG. 1.
Figure 44:
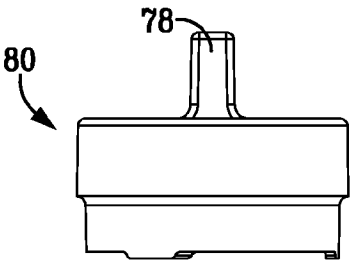
FIG. 44 is a rear view of the lock pawl of the latch of FIG. 1.
Figure 47:
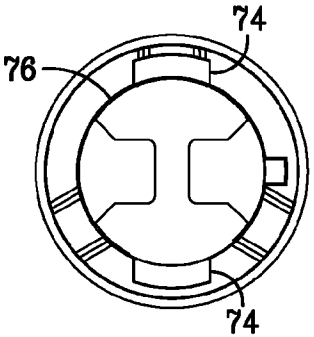
FIG. 47 is a bottom view of the lock pawl of the latch of FIG. 1.
Figure 48:
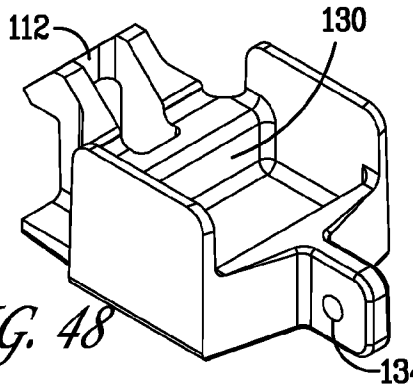
FIG. 48 is a perspective view of the shuttle of the latch of FIG. 1.
Figure 49:
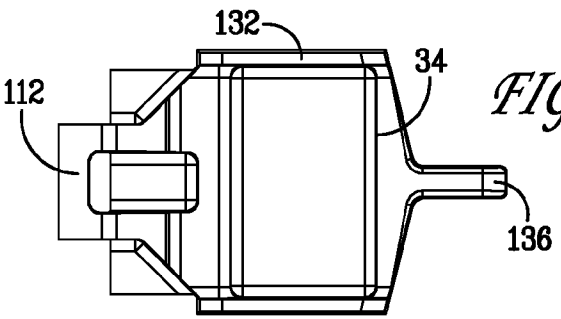
FIG. 49 is a bottom view of the shuttle of the latch of FIG. 1.
Figure 50:
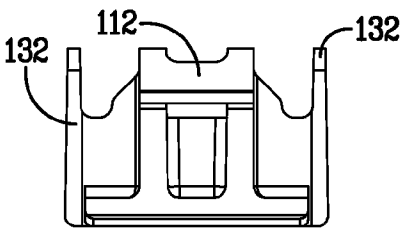
FIG. 50 is a rear view of the shuttle of the latch of FIG. 1.
Figure 51:
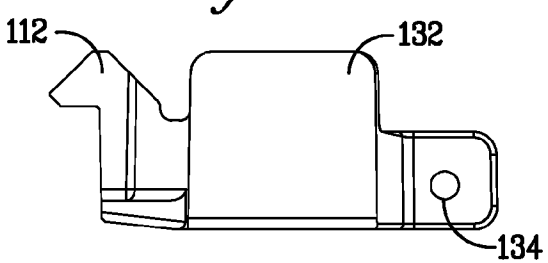
FIG. 51 is a left side elevational view of the shuttle of the latch of FIG. 1.
Figure 52:
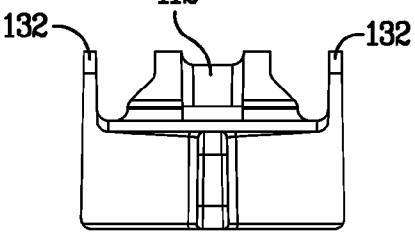
FIG. 52 is a front view of the shuttle of the latch of FIG. 1.
Figure 53:
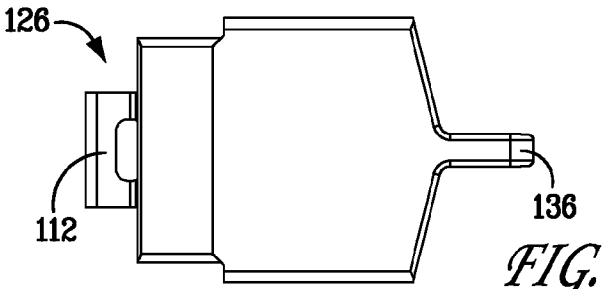
FIG. 53 is a top view of the shuttle of the latch of FIG. 1.
Figure 57:
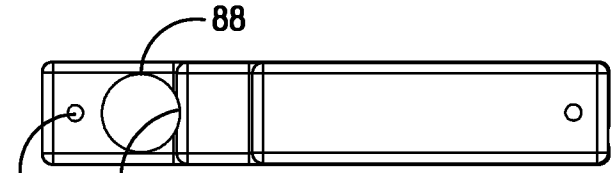
FIG. 57 is a top view of the mounting cup of the latch of FIG. 1.
Figure 59:
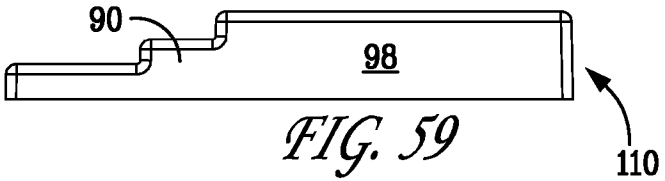
FIG. 59 is a right side elevational view of the mounting cup of the latch of FIG. 1.
Figure 60:
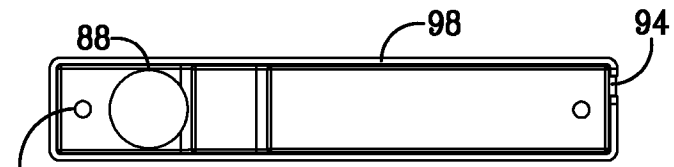
FIG. 60 is a bottom view of the mounting cup of the latch of FIG. 1.
Figure 56:
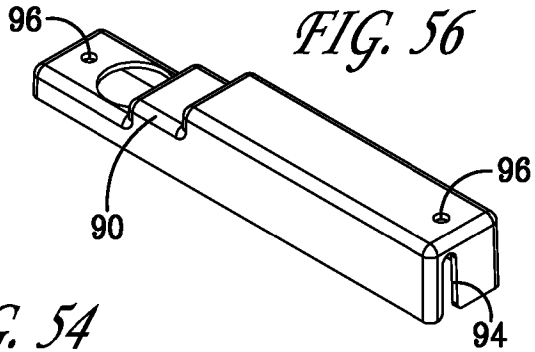
FIG. 56 is a perspective view of the mounting cup of the latch of FIG. 1.
Figure 58:
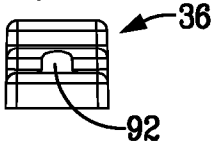
FIG. 58 is a front view of the mounting cup of the latch of FIG. 1.
Figure 54:
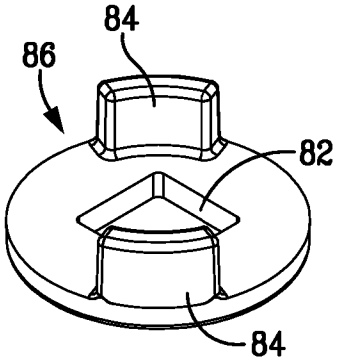
FIG. 54 is a perspective view of the cam restrictor of the latch of FIG. 1.
Figure 55:
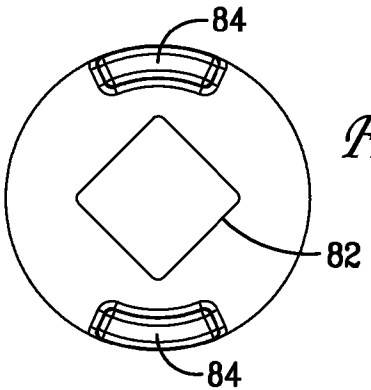
FIG. 55 is a top view of the cam restrictor of the latch of FIG. 1.
Figure 65:
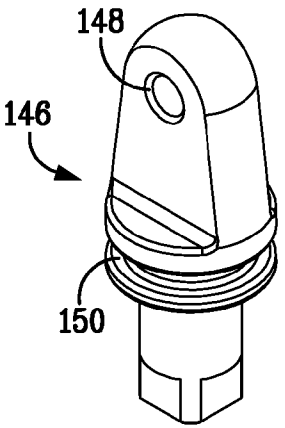
FIG. 65 is a perspective view of the pivot shaft of the latch of FIG. 1.
Figure 67:
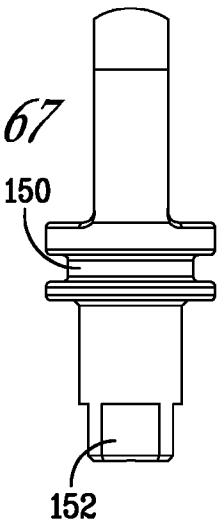
FIG. 67 is a front view of the pivot shaft of the latch of FIG. 1.
Figure 68:
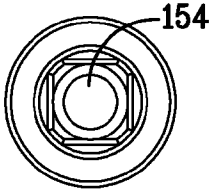
FIG. 68 is a bottom view of the pivot shaft of the latch of FIG. 1.
Figure 66:
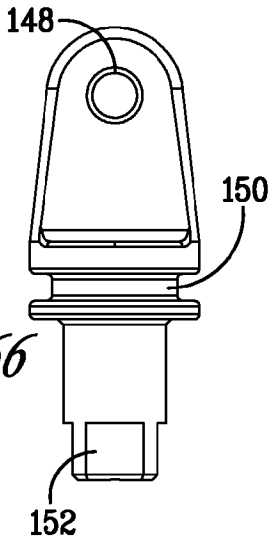
FIG. 66 is a side view of the pivot shaft of the latch of FIG. 1.
Figure 61:
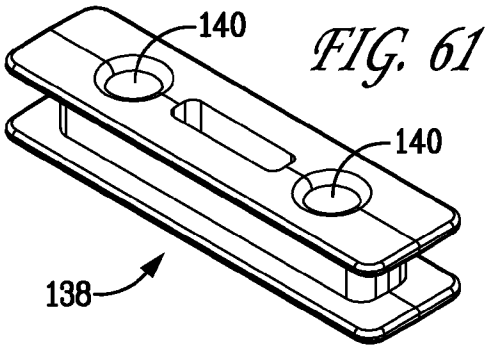
FIG. 61 is a perspective view of the bobbin of the latch of FIG. 1.
Figure 62:
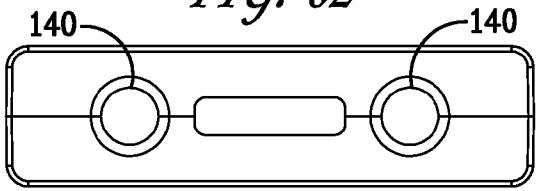
FIG. 62 is a top view of the bobbin of the latch of FIG. 1.
Figure 63:
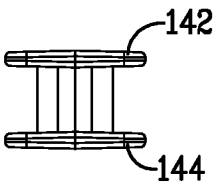
FIG. 63 is a front view of the bobbin of the latch of FIG. 1.
Figure 64:
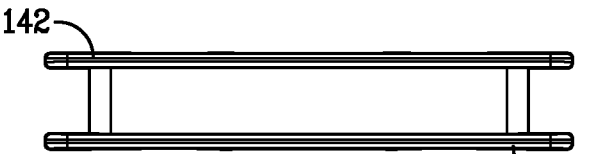
FIG. 64 is a side view of the bobbin of the latch of FIG. 1.

Lock plug 40 can be inserted in housing lock plug support 46 seen in FIG. 29 and has abutments which engage housing lock plug stop 58. Wafers 59 in lock plug 40 disengage housing wafer channel 60 upon insertion of a key (not shown) thus permitting rotation of key between the locked and unlocked positions. Lock pawl 80 shown in FIG. 41 fits onto the bottom of lock plug 40 by use of a wafer in lock pawl wafer channel 74. Lock plug 40 is inserted in housing 102 from above the housing 102. Lock plug protuberances extend and fit up into lock plug aperture 76. O-ring 85 seen in FIG. 13 fits between lock pawl 80 and housing so as to ease operation of the lock plug 40.

Figure 35:
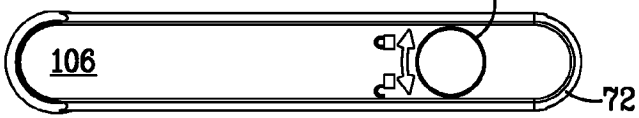
FIG. 35 is a top view of the handle of the latch of FIG. 1.
Figure 36:
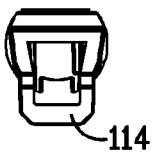
FIG. 36 is a rear view of the handle of the latch of FIG. 1.

Handle 106 has handle lock plug aperture 70 seen in FIG. 35. Handle 106 also has handle pin aperture 68 which received pivot shaft pin 10 to fasten pivot shaft 146 by means of pivot shaft aperture 148. Pivot shaft 146 has pivot shaft groove 150 which receives pivot shaft 0-ring 6 to ease swiveling of handle 106. Handle 106 has handle swivel end 120 which receives pivot shaft 146 which in turn engages housing pivot support 52 of housing 102.

Latch pawl 104 engages pawl latch engaging means 152 on pivot shaft 146 and latch pawl attaching means, here screw 8 to attach latch pawl 104 to pivot shaft 146.

Cam restrictor 86 which has cam restrictor aperture 82 permits approximately 90 degree rotation of the handle 106 in clockwise or counterclockwise direction by means of cam restrictor teeth 84 which abut against housing pivot abutments 156.

Housing boss 50 can be made of a polymer and extend through bobbin aperture 140 of bobbin 138 which has top portion 142 and bobbin bottom portion 144 which enclose an antenna (not shown). The tips of housing boss 50 which extend above bobbin cover 110 through bobbin cover apertures 66 can be melted and sanded or peened for a smooth finish for the top of bobbin cover 110 which has bobbin cover sidewalls 64. As seen in FIGS. 56 to 60, a mounting cup 36 which has mounting cup sidewalls 98 extending therefrom. Mounting cup aperture 96 provides a means for mounting cup attaching means 16, here screws to fit into housing 102. Mounting cup 36 has mounting cup slot 94 for receiving wires to cable connector 38.

The housing 102 can have housing flange 18 for fitting up against panel 108. The shuttle 126 has sidewalls 132 extending therefrom.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

I claim:

1. A latch capable of being installed on a first member to fasten the first member to a second member, said latch comprising:

a pawl capable of engaging the second member;

a handle connected to said pawl, wherein movement of said handle is capable of moving said pawl between a first position in which said pawl engages the second member and a second position in which said pawl does not engage the second member, said handle having a prong;

a shuttle having two ends wherein a stop is present at one end and a catch is present at the second end, said catch having an extension forming a hook, wherein said shuttle is capable of actuating between an engaged position wherein said hook engages said prong preventing movement of said handle and said pawl and an unengaged position wherein said hook does not engage said prong permitting movement of said handle and said pawl;

a lock pawl capable of actuating said shuttle between said engaged and unengaged position, wherein said lock pawl extends between said stop and said catch and said lock pawl having a lock pawl tooth being capable of maintaining said shuttle in the engaged position wherein said lock pawl tooth contacts said catch and said lock pawl tooth being capable of maintaining said shuffle in the unengaged position wherein said lock pawl tooth contacts said stop;

an electrically actuated locking means connected to said shuttle and capable of actuating said shuffle between said engaged and unengaged position when said lock pawl tooth is in a neutral position, wherein said neutral position is any position in which said lock pawl tooth is not maintaining said shuttle in the engaged or unengaged position.

2. The latch according to claim 1 wherein the electrically actuated locking means comprises a solenoid.

3. The latch according to claim 2 further comprising a biasing device for biasing the shuffle to the engaged position.

4. The latch according to claim 3 wherein the biasing device is a spring.

5. The latch according to claim 4 wherein the biasing device is a coil spring.

6. The latch according to claim 1 wherein the handle is swivelable.

7. The latch according to claim 1 wherein upon deenergization of said electrically actuated locking means said shuttle remains in the engaged position if said shuttle was in the engaged position prior to deenergization and said shuttle remains in the unengaged position if said shuffle was in the unengaged position prior to deenergization.

* * * * *